US011298838B2

(12) United States Patent
Jonák

(10) Patent No.: US 11,298,838 B2
(45) Date of Patent: Apr. 12, 2022

(54) KNIFE WITH EXTENSIBLE BLADE

(71) Applicant: Martin Jonák, Zlaté Hory (CZ)

(72) Inventor: Martin Jonák, Zlaté Hory (CZ)

( * ) Notice: Subject to any disclaimer, the term of this patent is extended or adjusted under 35 U.S.C. 154(b) by 0 days.

(21) Appl. No.: 16/623,338

(22) PCT Filed: May 30, 2018

(86) PCT No.: PCT/CZ2018/000024
§ 371 (c)(1),
(2) Date: Dec. 16, 2019

(87) PCT Pub. No.: WO2019/001599
PCT Pub. Date: Jan. 3, 2019

(65) Prior Publication Data

US 2021/0146556 A1 May 20, 2021

(30) Foreign Application Priority Data

Jun. 26, 2017 (CZ) ..... CZ2017-370

(51) Int. Cl.
*B26B 1/08* (2006.01)
*B26B 1/00* (2006.01)

(52) U.S. Cl.
CPC . *B26B 1/08* (2013.01); *B26B 1/00* (2013.01)

(58) Field of Classification Search
CPC ..... B26B 1/08; B26B 1/00
USPC ..... 30/334–336, 151, 158–164
See application file for complete search history.

(56) References Cited

U.S. PATENT DOCUMENTS 2,260,141 A 10/1941 Hanle
2,569,080 A * 9/1951 Trimble ..... B26B 5/006 30/320
4,265,017 A 5/1981 Collins
4,523,379 A 6/1985 Tekna
4,823,463 A 4/1989 Lemaire
4,858,320 A 8/1989 Lemaire
4,926,555 A 5/1990 Lemaire
5,349,753 A * 9/1994 Gaffney ..... A44B 11/263 24/166
5,511,311 A * 4/1996 Collins ..... B26B 1/08 224/232
7,086,158 B1 * 8/2006 Halpern ..... B26B 1/08 30/162

(Continued)

FOREIGN PATENT DOCUMENTS

CZ 28044 U1 3/2015
EP 0336905 A1 10/1989

(Continued)

*Primary Examiner* — Nhat Chieu Q Do
(74) *Attorney, Agent, or Firm* — Bryant J. Keller; Kirton McConkie

(57) ABSTRACT

A knife with an extensible blade is formed by a handle that defines a cavity in which the blade is placed. The cavity is open at least on the side adjacent to the blade tip. In the cavity, at least one guiding groove is formed, which guiding groove is blind near the front edge of the handle. The blade is equipped with at least one guiding member corresponding with the guiding groove of the handle. The handle cavity is further equipped with a pull-out groove. A pulling element that selectively connects to the blade leads through and protrudes out of the pull-out groove when the blade is in a retracted position.

12 Claims, 8 Drawing Sheets

(56) References Cited

U.S. PATENT DOCUMENTS

| | | | | |
|---|---|---|---|---|
| 8,671,578 | B1 | 3/2014 | Frazer | |
| 2003/0079347 | A1* | 5/2003 | Davis | B26B 27/005 30/2 |
| 2006/0207102 | A1* | 9/2006 | Bezold | B26B 1/08 30/162 |
| 2007/0175045 | A1 | 8/2007 | McHenry | |
| 2009/0235534 | A1 | 9/2009 | Chu | |
| 2013/0081281 | A1 | 4/2013 | Chu | |
| 2013/0305542 | A1 | 11/2013 | McChesney | |
| 2014/0101943 | A1 | 4/2014 | Chu | |
| 2018/0021964 | A1* | 1/2018 | Rohrbach | B26B 1/08 30/162 |

FOREIGN PATENT DOCUMENTS

| | | | |
|---|---|---|---|
| FR | 2744663 | A1 | 8/1997 |
| FR | 2928575 | A1 | 9/2009 |

* cited by examiner

KNIFE WITH EXTENSIBLE BLADE

FIELD OF THE INVENTION

Presented invention belongs to the area of manual cutting tools and refers to a knife with an extensible blade.

BACKGROUND OF THE INVENTION

In the area of extensible knives there exists a range of designs of extensible mechanism of a blade pull-out from a handle and its locking not only in open but also in closed position.

In the file U.S. Pat. No. 2,260,141 is described a knife with an extensible blade which is locked in retracted position by the help of a small leaf spring on back of the blade by whose pressing is the blade pulled out by the acting of gravitation. In a pulled out position is the blade fixed by locking of a protuberance which is also pressed by a flat spring into a groove on the back of the blade. Thus it is not possible to pull out the blade when the knife is oriented upward and the length of the blade is limited by the length of the handle. Similarly is made solution according to the file CZ 28044 U1 yet with a slightly different design of safety locks. In the file U.S. Pat. No. 4,265,017 is the blade designed to be partially slidable by the help of a swinging movement out of the lengthwise axis of a handle. Pulling out of the blade is not simple concerning the movement and evidently requires either cooperation of both hands or a high level of fine kinetic thus exercise and dexterity. Another example of flick knife design is mentioned in the file U.S. Pat. No. 4,523,379 where is used a quite complicated mechanism of flicking which uses power of a helical spring, which consists of many components and is difficult to produce. Another example of extensible knife is described in the file U.S. Pat. No. 4,823,463 where is the forward movement of the blade done by the help of a somehow complicated movement of one side surface panel of the handle and back retraction is done by the help of a spring. This design of the blade pull out is again quite complicated regarding movement. A simple design of blade sliding is described in the file U.S. Pat. No. 4,926,555 where the pull out of the blade is done by a movement of a slider which is fixed to the blade in a groove which is made in one side of the handle. The pull out of the blade is done by the help of a thumb which results in decreased stability and firmness of knife grip. Further there is a danger of intrusion of impurities into the inner part of the knife through the mentioned groove and following problems of blade movement. Similar solution is mentioned also in the file U.S. Pat. No. 4,858,320. Design of a knife with extensible blade according to the file FR2744663 uses quite complicated mechanism of blade locking in end positions which has many elements protruding from the surface of the knife. Moreover this design does not enable simple and fast pull out of the blade and at the same time firm grip and the length of the blade is also limited by the length of the handle. A flick knife which is described in the file US 20070175045 uses for movement of blade a system of inner springs which has many internal parts which decrease its reliability and increases production costs and also weight. Similar problem has also design described in the file U.S. Pat. No. 8,671,578. Next design of flick knife is described in the file US 20130305542. In the file FR2928575 is fixation of the blade done by the help of flat springs which are embedded inside of the body of the knife, a pull out movement again requires forward movement of a slider by a thumb of hand on bottom part of handle which decreases not only stability and firmness of the knife grip but also speed of pull out of the blade. Similar design, only with a slider placed on the side of handle and furthermore with use of a helical spring for retraction of the blade back which increases production costs and also weight of the knife, is described in the file US 20090235534. Very similar design only without repulsing spring is mentioned in the file US 20130081281 and US20140101943.

On current market is not offered a knife which would have blade hidden in a handle and after its opening or pull out would have characteristic of a solid knife with fixed blade, thus would have the blade in the same length or longer than the handle and the knife would, in an open position, have a very firm connecting of the blade and the handle to be impossible during any work or activity with the knife to practically break this connection. Present designs of connection of the blade with the handle are made in the way which does not enable to use the blade for prying or cutting without risk of loosening of the blade from the handle and damage of the knife. All currently offered knives with a movable blade have always the blade shorter than the handle. Last but not least there is necessary, by the knives with movable blade, to carry out opening, pull out or flick of the blade after the knife was taken from a pocket or a case. There is not on the market a knife which would, during taking out from a case or unfastening from a suspension place with a firm grip, start to open automatically and at finishing of the pull out in one single movement to be already ready to use.

The aim of presented invention is to introduce a knife with an extensible blade whose blade would be in pulled out position firmly fixed in the handle whereas it would be at least as long as an independent handle itself and at the same time would be possible to open it easily in single movement during simultaneous unfastening from a suspension place on the body of a carrier.

SUMMARY OF THE INVENTION

The defined goal is reached with invention which is a knife with an extensible blade which is formed with a handle equipped with a lengthwise handle cavity in which is slidably in the direction of the lengthwise axis of the knife placed a blade which has mutually opposed a point and a blunt edge where the handle cavity is open at least in direction towards the point. The essence of the invention is that, that in the inner surface of the handle cavity is in the handle in direction of the lengthwise axis of the knife formed not only at least one guiding groove which is blind in direction toward the point in front of the edge of the handle but also a pull out groove in the lengthwise direction open at least in direction toward the point. The blade is not only in its end part of its blunt edge on its surface equipped with at least one guiding member, which in its shape and size corresponds with a transversal cross section of the guiding groove, which is on the transversal cross section of the blade placed in the same position in which adjoins the guiding groove to this transversal cross section, but also is equipped with a joint element which is placed on its transversal cross section in the same position in which to this transversal cross section adjoins the lengthwise axis of a pull out groove whereas the joint element is placed in bigger distance from the blunt edge of the blade than the guiding element. A part of the knife is a pull out module which is formed with a linear pulling element with is on its one end equipped with a connecting member which is equipped with a joint member which compatibly connectable with a joint element of the blade from which is at the same time detachable without use of force whereas the joint element corresponds with its size and shape with the transversal inner cross section of pulling groove in which is positioned when the blade is retracted, when the joint element is connected with joint member and pulling element is led out through the pulling groove out of the handle.

In preferred design is in the handle of the knife in direction of the axis which is perpendicular to the lengthwise axis of the knife formed a through locking opening which leads to handle cavity whose distance form the edge of the handle to which heads point of the blade is determined by sum of distances of blind ends of guiding grooves form the edge of the handle and distance of guide elements form the blunt edge of the blade. In the locking opening is slidably placed a safety lock which is fixed in the end area of free end of locking pressure element which is made of flexible material which is fixed in its second end area to outer surface of the handle, whereas the size of the safety lock from the surface of the handle in direction into the handle cavity is bigger than is width of the wall of the handle in this area.

Also is preferable when the handle cavity and also the pulling groove are passable through the whole length of the handle and in the inner surface of the handle cavity is in the handle, in the direction of the lengthwise axis of the knife, formed a retractable groove which is in the lengthwise direction toward to the point of the blade open and in the opposite direction blind in front of the end of the handle, whereas the blade is equipped with a stop element which corresponds in size and shape with the shape of the inner cross section of the retractable groove and is placed on the transversal cross section of the blade in the same position in which, to this transversal cross section, adjoins the lengthwise axis of the retractable groove. The distance of the stop element from the blunt edge of the blade matches the difference of total length of the body of the knife with retracted blade and the length of the retractable groove.

In another advantageous design is in the handle in direction of the lengthwise axis of the knife formed an elongated lock bed whose end, which is directed toward the point of the blade, is open outward from the handle in the level which is perpendicular to its lengthwise axis namely at an angle at least 90°. In the lock bed is along its whole length pivoted a rod-shaped rotary controller with a circular cross section which is equipped on its on end, which is directed toward the point of the blade, with a manipulator which is designed as a curvature at right angle to its lengthwise axis and which overlaps the outer outlines of the knife.

It is preferable when the lock bed is along its one lengthwise side open outward from the handle when is on its end which is directed away from the point of the blade not only open into the perpendicular level to its lengthwise axis in an angle at least 90° but also is on this end overlapped with the free end of the locking pressure element which is produced from a springy material which is on the area of its second end part fixed to the surface of the handle. Under free end area of the locking pressure element is in the handle in the perpendicular direction to the lengthwise axis of the knife formed a passable locking passage leading into a handle cavity, whose position and the cross section when the blade is retracted corresponds with position of a locking opening which is formed in the blade. The rotary controller is on its end which reaches under the free end of the locking pressure element equipped with an excenter, whereas in the locking passage is slidably placed a locking pin which is fixed on the locking pressure element. The size of the locking pin from the surface of the handle in direction toward the handle cavity is bigger than is the width of the wall of the handle in this area.

Also is advantageous when the rotary controller is on its end which is directed away from the point of the blade equipped with a locking pin when at the end of the lock bed in direction away from the point is formed a locking cavity leading to the handle cavity which is modified in size and shape to swinging movement of the locking pin. The locking pin reaches in one from its end positions into the handle cavity, whereas in the blade is formed a locking notch which, when the blade is retracted, corresponds in size and position with the locking pin.

Presented invention is more efficient because for preparation of the knife to working position is enough to grip tight the handle and in one movement take away the knife from the point of the grip namely without necessity to change the grip or another following movement of the handle or fingers whereas the knife has the same strength characteristics as a knife with solid blade, in some preferred designs the blade is at least as long as the handle or longer.

DESCRIPTION OF THE DRAWINGS

The particular designs of the invention are schematically illustrated in following drawings where.

DETAILED DESCRIPTION OF EMBODIMENTS OF THE INVENTION

Figure 1:
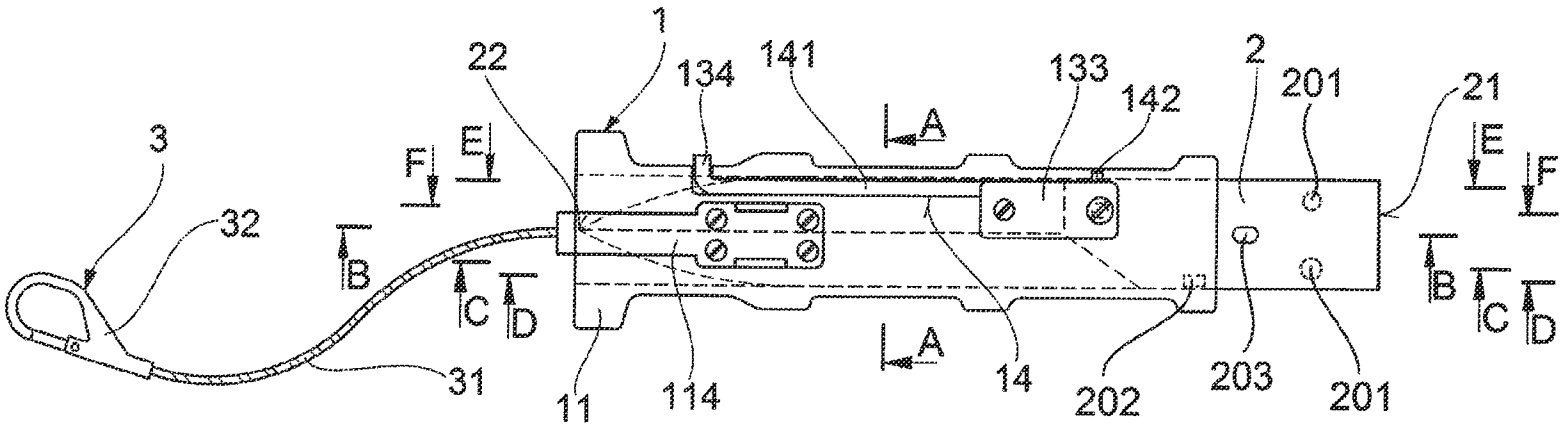
FIG. 1 is a side view of the knife with an extensible blade from the side of a locking part of the handle in position with retracted blade
Figure 2:
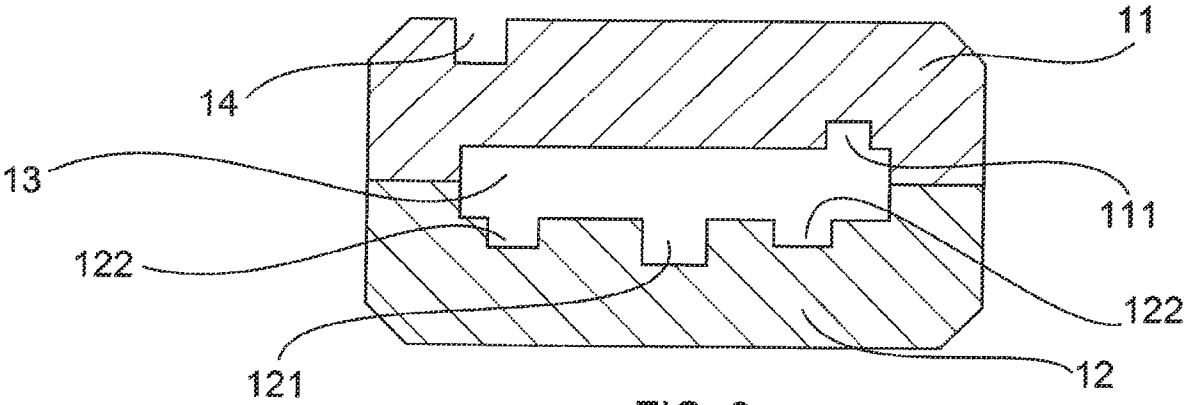
FIG. 2 is a transversal section of the handle of the knife in perpendicular plane to projection of FIG. 1 which is done along the line A-A
Figure 3:
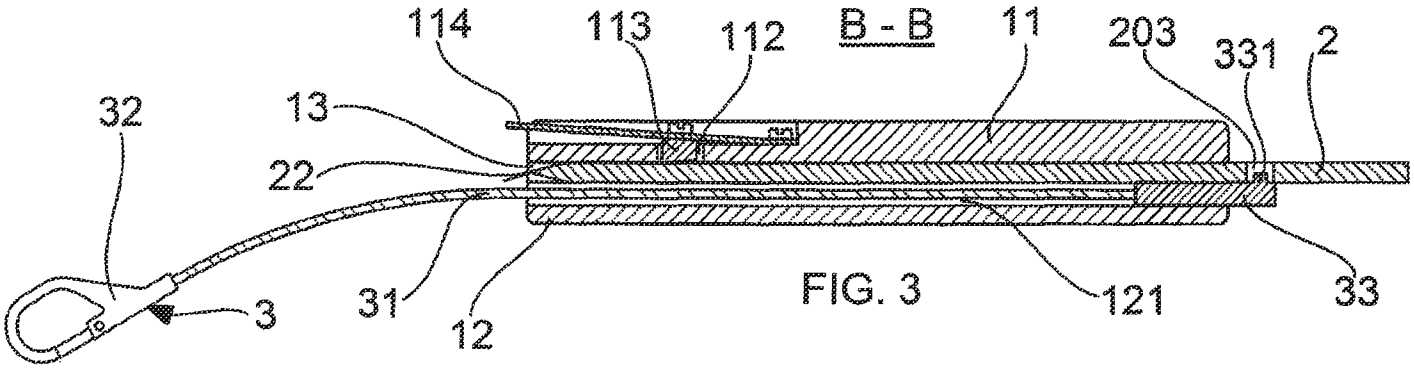
FIG. 3 is a lengthwise section of the knife in the position with retracted blade in perpendicular plane to projection of FIG. 1 which is done along the line B-B
Figure 4:
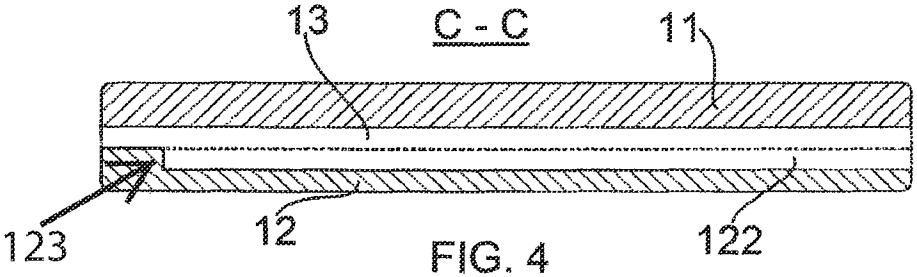
FIG. 4 is a lengthwise section of the handle of the knife in perpendicular plane to projection of FIG. 1 which is done along the line C-C
Figure 5:
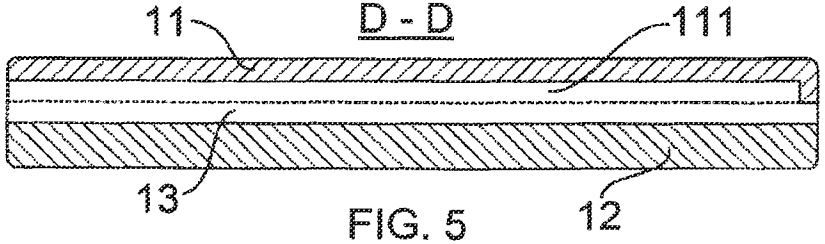
FIG. 5 is a lengthwise section of the handle of the knife in perpendicular plane to projection of FIG. 1 which is done along the line D-D
Figure 6A:
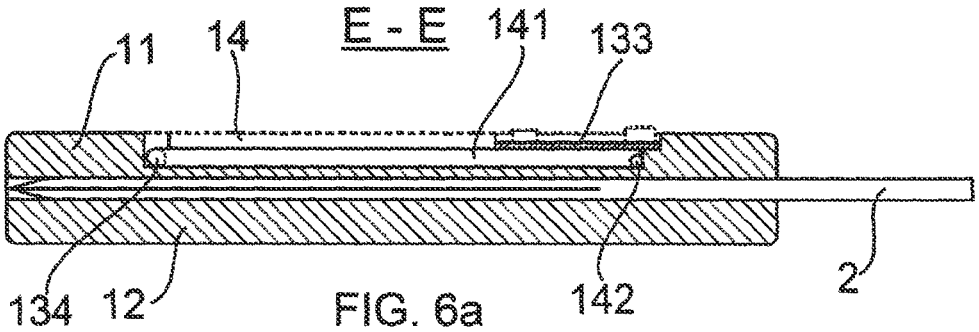
FIG. 6*a* is a lengthwise section of the knife in the plane which is perpendicular to projection of FIG. 1 done along the line E-E in position with retracted blade and a sliding lock in locked position
Figure 6B:
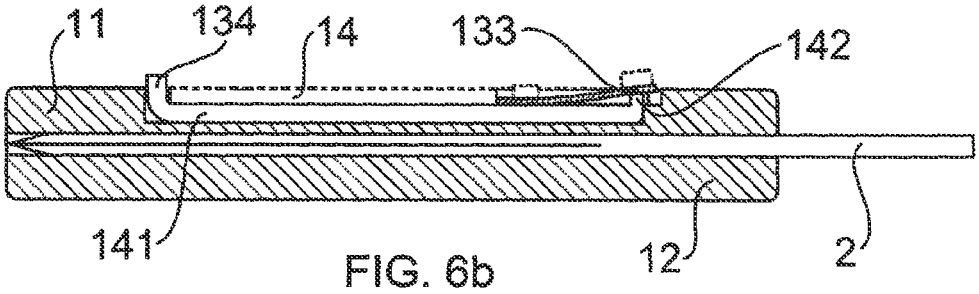
FIG. 6*b* is a lengthwise section of the knife in the plane which is perpendicular to projection of FIG. 1 done along the line E-E in position with retracted blade and a sliding lock in unlocked position
Figure 7A:
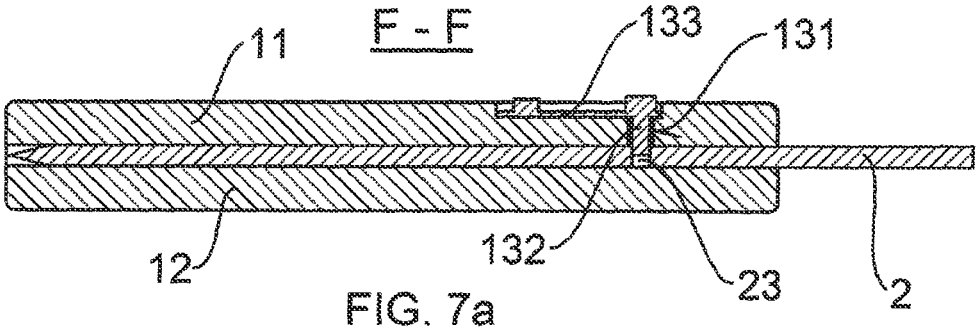
FIG. 7*a* is a lengthwise section of the knife in the plane which is perpendicular to projection of FIG. 1 done along the line F-F in position with retracted blade and the sliding lock in locked position
Figure 7B:
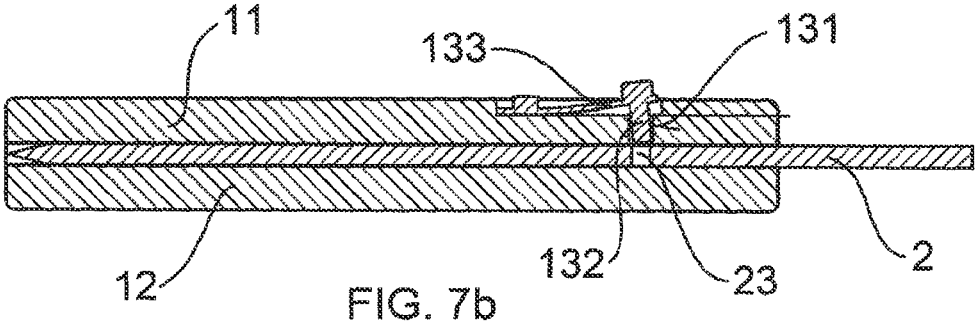
FIG. 7*b* is a lengthwise section of the knife in the plane which is perpendicular to projection of FIG. 1 done along the line F-F in position with retracted blade and the sliding lock in unlocked position
Figure 8:
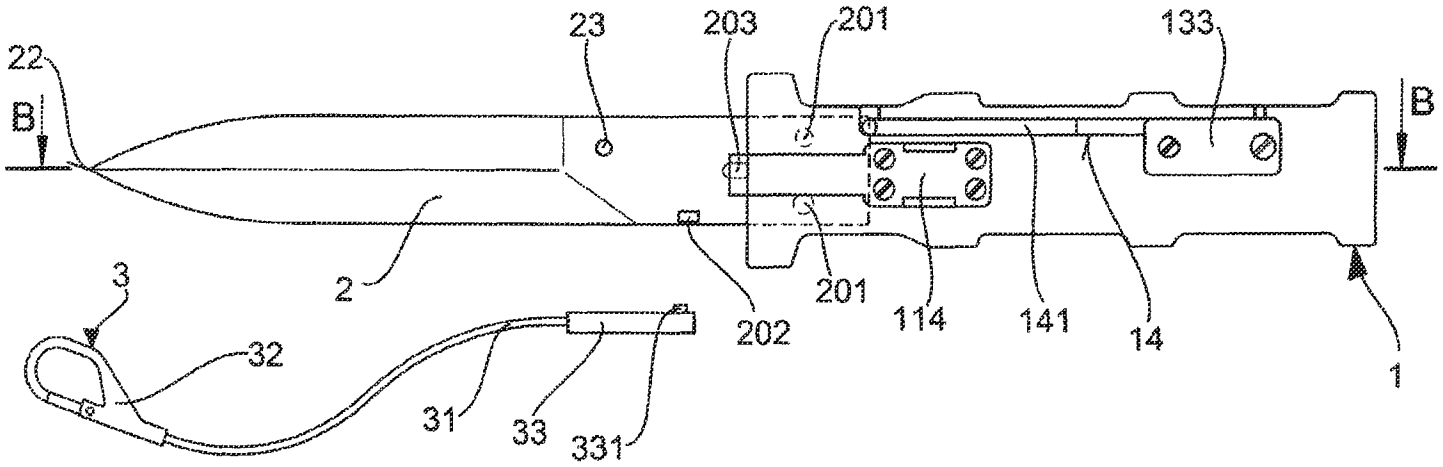
FIG. 8 is a side view of the knife with extensible blade from the side of locking part of the handle in position with extended blade
Figure 9:
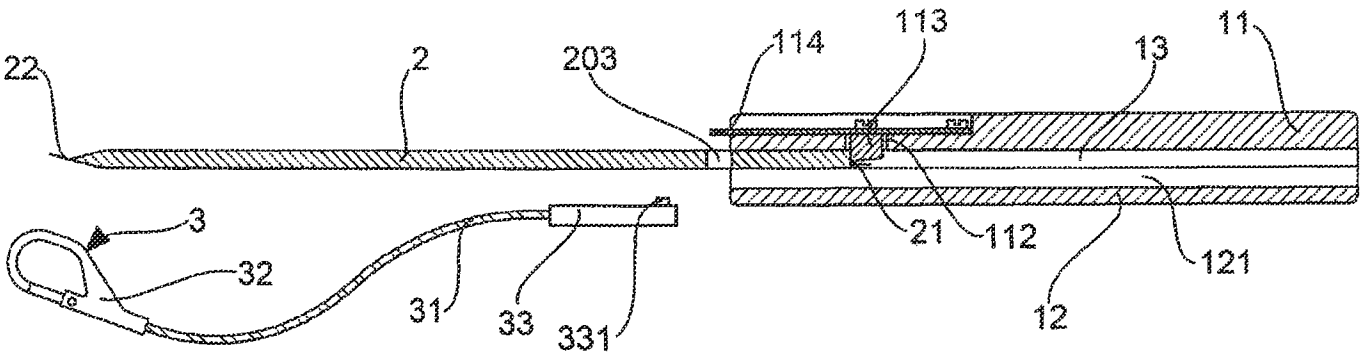
FIG. 9 is a lengthwise section of the knife in the position with extended blade in perpendicular plane to projection of FIG. 8 which is done along the line B-B

The knife with extensible blade in its basic design illustrated in FIG. 1 consists of a lengthwise divided handle 1 which is formed with a locking part 11 and a guiding part 12 which are mutually fixed to each other. There is the lengthwise direction in the handle 1 between the locking part 11 and the guiding part 12 formed a passable handle cavity 13 in which is slidably placed a flat blade 2 which has not only a blunt edge 21 but also a point 22.

In inner area of the handle cavity 13 is in the direction of the lengthwise axis of the knife formed not only a passable pull out groove 121 but also 2 guiding grooves 122 which are in direction toward the blunt edge 21 of the blade 2 in the lengthwise direction open and in the direction toward the point 22 are blind (e.g., comprise a stop 123) in front of the end of the handle 1. In the locking part 11 of the handle 1 is from its inner part which forms a inner surface of the handle cavity 13 in direction of the lengthwise axis of the knife formed a retractable groove 111 which is in direction toward the point 22 of the blade 2 in its retracted position open and in direction to the blunt edge 21 of the blade 2 is blind in front of the end of the handle 1.

The blade 2 is in its end part of the blunt edge 21 on its surface equipped with 2 guiding members 201 which correspond in size and shape with transversal cross section of the guiding grooves 122 whereas the guiding members 201 are on the transversal cross section of the blade 2 placed in the same position in which to the transversal cross section of the blade adjoin the guiding grooves 122. The blade is further equipped with a stop element 202 whose distance from the blunt edge 21 of the blade 2 corresponds with the difference of the whole length of the body of the knife with retracted blade 2 and the length of the retractable groove 111. Position of the stop element 202 on the transversal cross section of the blade is given by the spot to which to the transversal cross section of the blade 2 adjoins the retractable groove 111. In the area between the guiding members 201 and the stop element 202 is the blade 2 equipped with a connecting member 203 which is formed preferably as a recess or an opening in the surface of the blade 2. Position of the connecting member 203 on the transversal cross section of the blade corresponds with the spot to which to the transversal section of the blade adjoins the lengthwise axis of the pull out groove 121.

A part of the knife with extensible blade is an extensible module 3 which is formed with a linear pulling element 31 preferably made of a flexible rollable material which is at its one end equipped with a fixture element 32 preferably a snap hook and at its second end with a joint member 33 which is equipped with a connecting element 331 preferably a pin. The connecting element 331 is compatible with the connecting member 203 of the blade 2 with which forms connectable and at the same time easily disconnectable couple of counterparts. The joint member 33 corresponds in size and shape with the transversal inner cross section of the pull out groove 121 in which is placed when the blade 2 is retracted whereas the connecting element 331 is then connected with the connecting member 203 and the pulling element 31 is then taken through the pull out groove 121 out from the handle 1.

In the locking part 11 of the handle 1 is in the perpendicular direction to the lengthwise axis of the knife formed a locking hole 112 directed into the handle cavity 13. The distance of the locking hole 112 from the rim of the handle to which heads the point 22 of the blade 2 is given by sum of distances of the blind ends of the guiding grooves 122 from the rim of the handle 1 and the distance of the guiding member 201 from the blunt edge 21 of the blade 2. Through the locking hole 112 goes a safety lock 113 which is on the outer part of the knife fixed on the free end of the flat locking pressure member 114 which is made of a springy material and is fixed by its second end flat on the outer surface of the locking part 11 of the handle 1.

The locking pressure member 114, in the direction of the lengthwise axis of the knife, outreaches the rim of the handle 1. The safety lock 113, when the blade 2 is extended, reaches into the space of the handle cavity 13 and is adjacent to the blunt edge 21 of the blade 2.

On the outer surface of the locking part 11 of the handle 1 is in the direction of the lengthwise axis of the knife formed a lock bed 14 in the shape of an elongated recess whose ends are also right angle open to its lengthwise axis in the direction out from the handle 1 in an axis which is parallel with the surface of the blade 2. The end part of the lock bed 14 which is closer to the blunt edge of the blade 2 is in its retracted position overlaid with the free end of the flat locking pressure element 133 which is made of springy material which is by its second end fixed flat to the surface of the locking part 11 of the handle 1. Under the free end of the locking pressure element 133 is in the handle 1 in the perpendicular direction to the lengthwise axis of the knife formed a lock passage 131 leading to the handle cavity 13 whose position corresponds with the locking hole 23 which is formed in the blade 2 when the blade 2 is retracted. When the blade 2 is retracted into the locking hole 23 interlocks the lock pin 132 which further goes through the lock passage 131 and which is on the outer part of the knife fixed to the locking pressure element 133.

In the lock bed 14 is pivoted a rod shaped rotary controller 141 with a circular cross section which is equipped at the distant end from the locking pressure element 133 with a manipulator 134 designed as a right angle curvature to the lengthwise axis of the rotary controller 141 whereas the manipulator 134 overreaches the outer outlines of the knife. On the opposed end the rotary controller 141 in the lock bed 14 reaches under the locking pressure element 133 and is at this end equipped with an excenter 142.

Figure 10:
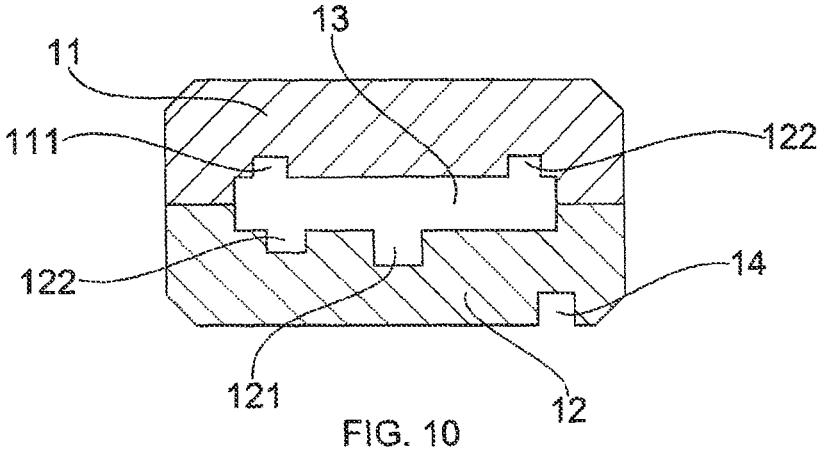
FIG. 10 is a transversal section of the blade of the knife in plane which is perpendicular to the lengthwise axis of the knife with an alternative positioning of the sliding lock, guiding groove and lock bed

Position of the retractable groove 111 in the locking part 11 of the handle 1, the guiding grooves 122 in the guiding part 12 of the handle 1 a position of the lock bed 14 with the rotary controller 141 and the locking pressure element 133 on the guiding part 12 is not only possible design. In an alternative design which is illustrated in FIG. 10 is the retractable groove 111 placed in the locking part 11, one guiding groove 122 is placed in the locking part 11 and one guiding groove 122 is placed in the guiding part 12 and the lock bed 14 with the rotary controller 141 and the locking pressure element 133 is placed on the guiding part 12 of the handle 1.

Figure 11:
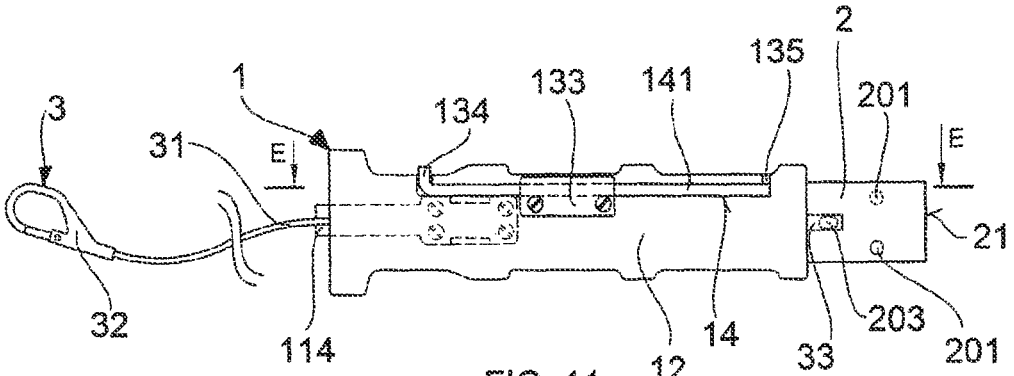
FIG. 11 is an alternative design of the lock bed with a rotary controller in locked position and with retracted blade
Figure 12:
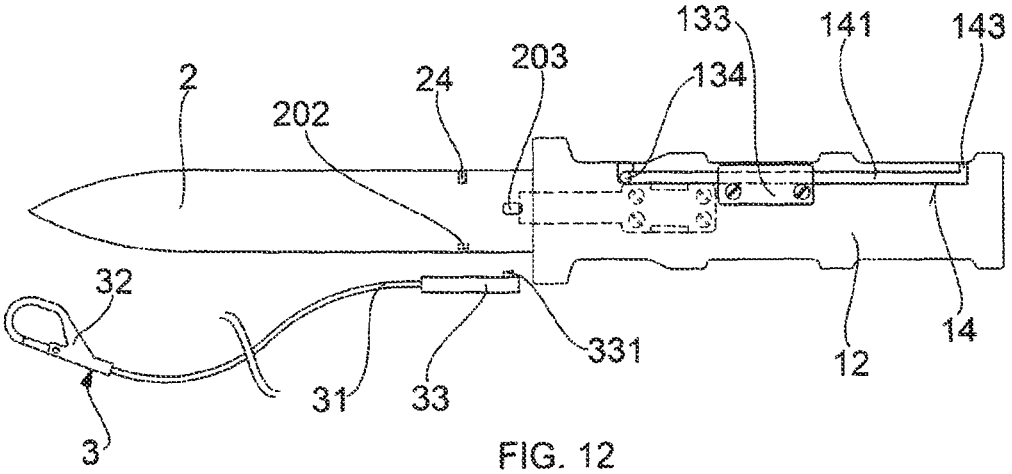
FIG. 12 is an alternative design of the lock bed with the rotary controller in unlocked position and with extended blade
Figure 13A:
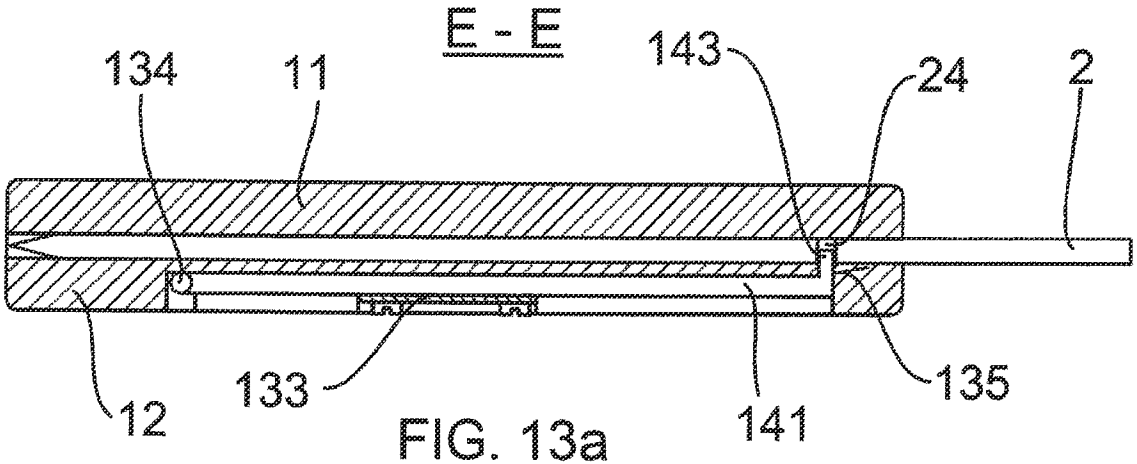
FIG. 13*a* is a lengthwise section of the knife in the plane which is perpendicular to projection of FIG. 11 done along the line E-E in position with retracted blade and the rotary controller in locked position
Figure 13B:
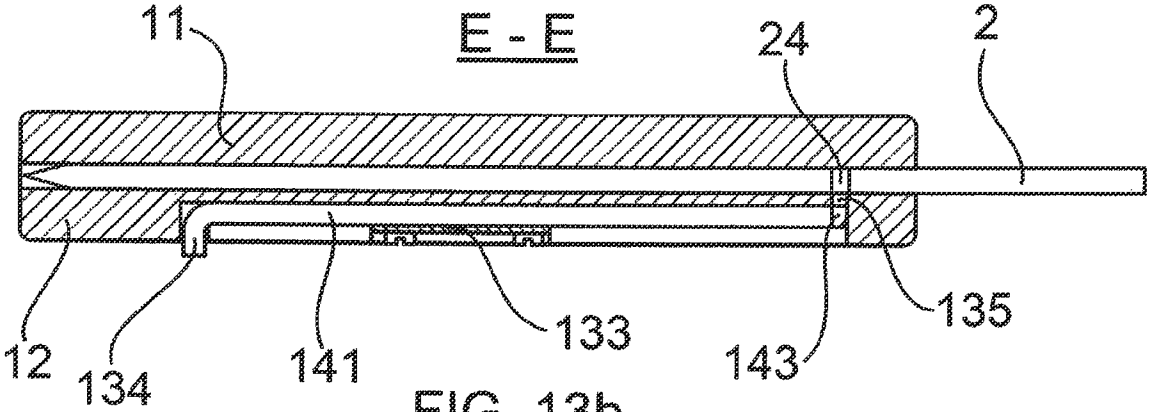
FIG. 13*b* is a lengthwise section of the knife in the plane which is perpendicular to projection of FIG. 11 done along the line E-E in position with retracted blade and the rotary controller in unlocked position

Another alternative design which is illustrated in FIGS. 11, 12 and 13 is design of the lock bed 14 with the rotary controller 141 and the locking pressure element 133 on the guiding part 12 of the handle 1. There is the rotary controller 141 on its closer end to the blunt edge 21 of the blade 2 in its retracted position equipped with a locking pin 143 which forms a right angle not only with the lengthwise axis of the rotary controller 141 but also with the axis of the manipulator 134. In the handle 1 is in this design at the end of the lock bed 14 which is closer to the blunt edge 21 of the blade 2 in its retracted position formed a lock cavity 135 which reaches into the handle cavity 13 and which in size and position corresponds with the locking pin 143 which in the locked position interlocks in a lock notch 24. The locking pressure element 133 is in this design fixed to the surface of the handle 1 at both ends.

Figure 14:
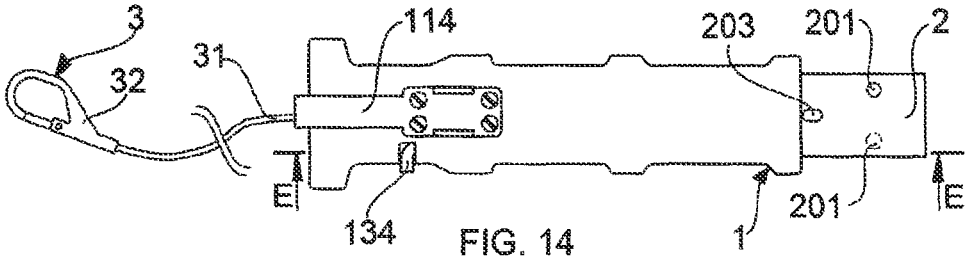
FIG. 14 is another alternative design of the lock bed with the rotary controller with blade in retracted position
Figure 15A:
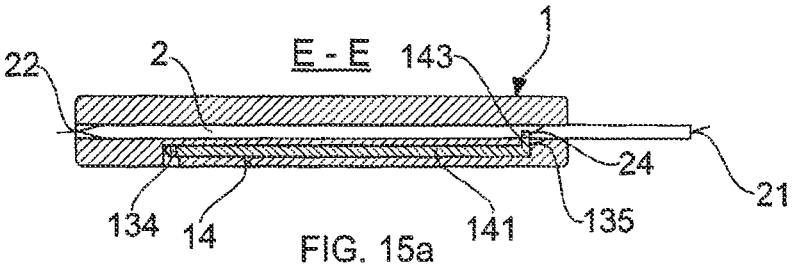
FIG. 15*a* is a lengthwise section of the knife in the plane which is perpendicular to projection of FIG. 14 done along the line E-E in position with retracted blade and the rotary controller in locked position
Figure 15B:
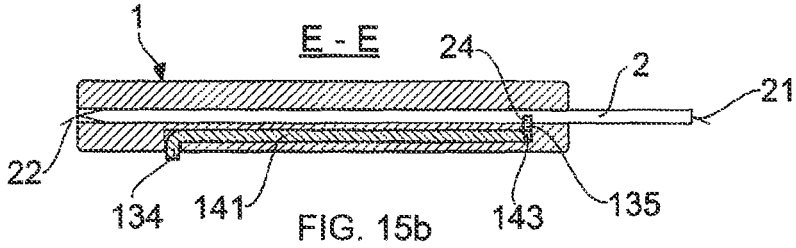
FIG. 15*b* is a lengthwise section of the knife in the plane which is perpendicular to projection of FIG. 14 done along the line E-E in position with retracted blade and the rotary controller in unlocked position
Figure 16:
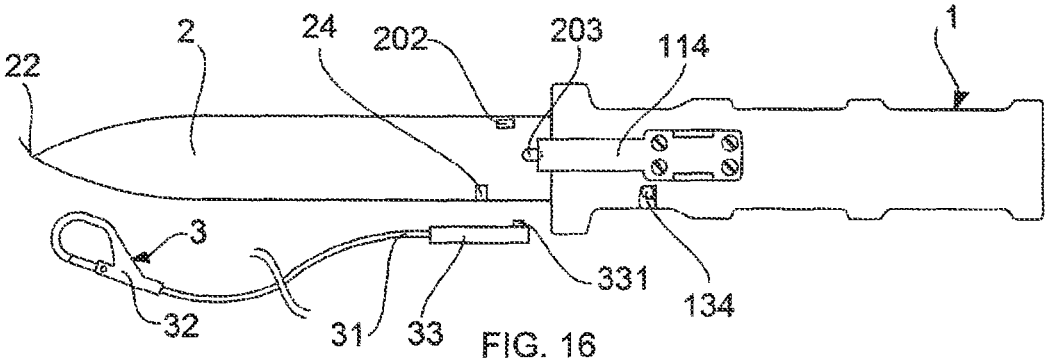
FIG. 16 is the knife from FIG. 14 with extended blade
Figure 17:
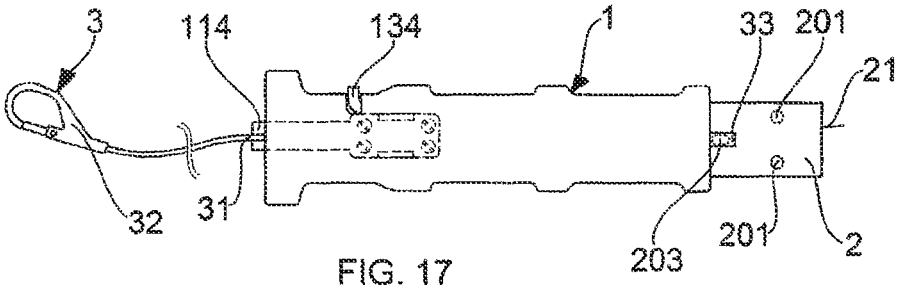
FIG. 17 is an alternative position of the lock bed with the rotary controller from FIG. 14

Another variant of the design is illustrated in FIGS. 14, 15 and 16 when the lock bed 14 is designed as a lengthwise closed cavity which goes through body of the handle 1 in the parallel axis with the lengthwise axis of the knife. The lock bed 14 is at the end which is closer to the point 22 of the blade 2 in its retracted position open out from the handle 1 into the plane which is perpendicular to its lengthwise axis namely in the extent of the angle at least 90°. At its second end which is closer to the blunt edge 21 of the blade 2 when retracted, the lock bed 14 leads to the lock cavity 135 which is formed inside of the body of the handle 1 in the plane which is perpendicular to the lengthwise axis of the lock bed 14 and which leads into the handle cavity 13. In the lock bed 14 is placed a rotary controller 141 which is at its one end equipped with a manipulator 134 which is taken out from the handle 1 and at its second end with a locking pin 143 which goes into a lock cavity 135 which is modified to the shape and size of the locking pin 143. The manipulator 134 and the locking pin 143 are formed as a right angle curvature forming mutually 90° angle. Alternatively can be the lock bed 14 with the rotary controller 141 and the locking cavity 135 placed on opposed part of the handle 1 or on the same part of the handle 1 as is it illustrated in FIG. 17.

Figure 18:
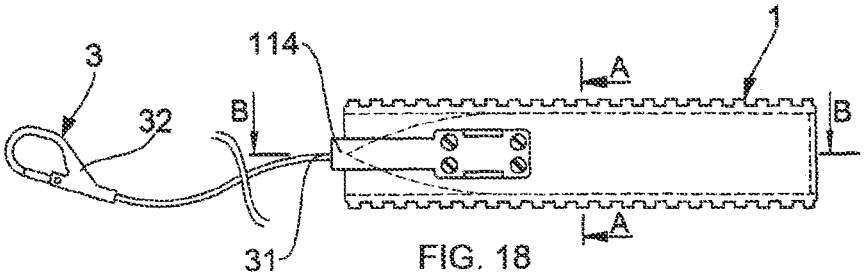
FIG. 18 is an alternative design of the knife with blade completely hidden in the handle
Figure 19:
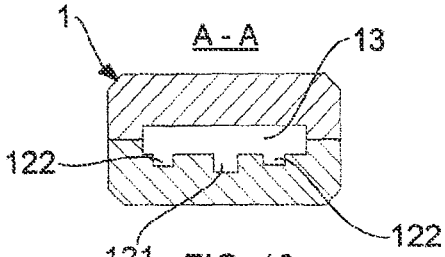
FIG. 19 is a transversal section of the handle in the perpendicular plane to the projection of FIG. 18 done long the line A-A
Figure 20:
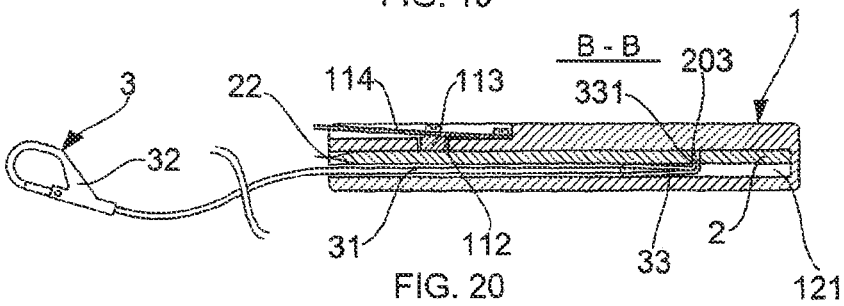
FIG. 20 is a lengthwise section of the knife in perpendicular plane to the projection of FIG. 18 done along the line B-B
Figure 21:
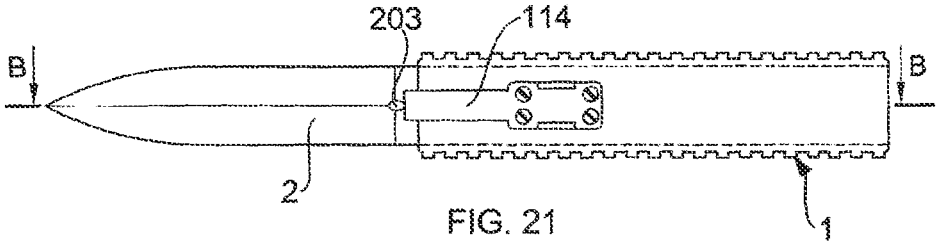
FIG. 21 is the knife from FIG. 18 with extended blade
Figure 22:
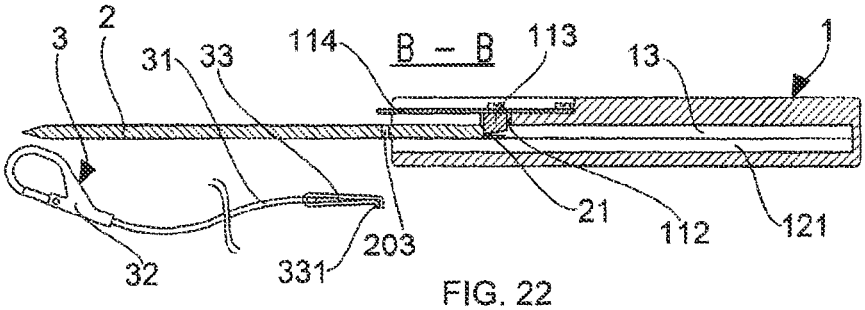
FIG. 22 is a lengthwise section of the knife in perpendicular plane to projection of FIG. 21 done along the line B-B The drawings which illustrate presented invention and below described examples of particular design do not in any case anyhow limit the extend of the protection mentioned in the definition yet merely clarify essence of the invention.

In an alternative design—illustrated in FIGS. 18, 19 and 20 the knife is not equipped with a lock bed 14, a rotary controller 141, a locking pressure element 133, a locking passage 131, a locking hole 23 and also a locking pin 132. In this design the knife does not contain a retractable groove 111 and at the same time a handle cavity 13 is concurrently with the end of the blade 2 in its retracted position blind together with it are blind also guiding grooves 122.

In this design is the joint member 33 made as a steel wire which is at its end right angle curved where the connecting element 331 is formed by this curved part of the wire.

In a basic standby mode is the knife fixed on the body of a bearer and the pulling element 31 is either by the help of a fixture element 32 firmly fixed or simply tied with the fixture spot on the body of the bearer. The blade 2 is retracted in the handle cavity 13 when the stop element 202 is at the end of the retractable groove 111 in the place of its blind and the side of the blunt edge 21 of the blade 2 exceeds in the lengthwise direction out from the handle 1. Alternatively the blade 2 is completely retracted to the blind of the handle cavity 13. The pulling element 31 is from the body of the bearer led in direction from the point 22 through pull out groove 121 of the handle 1 to its second part where is by the help of the joint member 33 which is situated from bigger part in the pull out groove 121 and the connecting element 331 fixed to the blade 2 by the help of its connecting member 203 which together with the connecting element 331 forms a compatible couple of counterparts pin-hole. Locking of the connecting element 331 in the pull out groove 121 ensures their connection. The rotary controller 141 is in the position when the excenter 142 has its wider part directed into the parallel direction with the plane of the blade 2 and does not lift the lock pressure element 133 thus the lock pin 132 which goes through the lock passage 131 interlocks in the locking hole 23 of the blade 2. Alternatively the locking pin 143 goes through the locking cavity 135 and goes to the space of the handle cavity 13 where interlocks in the lock notch 24 of the blade 2 which is thereby locked in retracted position. By rotation of the rotary controller 141 by the help of movement of the manipulator 134 there comes to change of the position of the excenter 142 which will then be positioned with its wide part to flat locking pressure element 133 whereby lifts its free end with fixed locking pin 132 which thus goes from the space of the handle cavity 13 and the blade 2 is unlocked. Alternatively there comes, by rotation of the rotary controller 141, to tilt of the locking pin 143 from the space of the handle cavity 13 and also from the lock notch 24 and the blade 2 is unlocked. Next movement of the handle 1 in direction away from the body of the bearer comes to formation of pulling force which acts through the pulling element 31 on the blade 2 which extends out from the handle 1 whereas the guiding members 201 during this movement go through the guiding grooves 122 and stops when hits the blinds and thereby is terminated movement of the blade 2. In this moment the safety lock 113 pressured in direction toward the blade 2 by the locking pressure member 114 locks behind the blunt edge 21 of the blade 2 which is this way locked in the extended position.

In the final phase of this movement of the blade 2 comes to spontaneous disconnection of the connecting member 203 and the connecting element 331 as a result of pull-out of the joint member 33 from the pull out groove 121.

The knife with extensible blade is suitable especially for situations where is necessary by the help of a quick intuitive movement to grab the self-defense mean of cutting and stabbing type which is directly by this movement immediately ready to use and therefore is designed either for self-defense purposes of the civilians or organized armed units.

I claim:

1. A knife having an extensible blade, the knife comprising:

a handle having: a front end, a back end, an exterior, and a handle cavity that is located inside the handle, wherein the handle cavity is open at least at the front end of the handle, the handle cavity defining:

a guiding groove extending from a first location toward the back end of the handle to a second location toward the front end of the handle, wherein the guiding groove comprises a stop toward the front end of the handle; and a pull-out groove that extends along a length of the handle and that is open at least at the front end of the handle; and a blade with a point, a blunt end, a guiding member that corresponds in shape, size, and position with the guiding groove;

a connecting member on the blade that corresponds in position with the pull-out groove, wherein the connecting member is placed closer to the point of the blade than is the guiding member with respect to the point of the blade;

a pulling element that is equipped at one end with a joint member, wherein the joint member is equipped with a connecting element that is selectively connectable with the connecting member of the blade, wherein the joint member further corresponds in shape, size, and position with the pull-out groove, and wherein the pulling element is configured to extend through the pull-out groove out from the handle when the blade is in a retracted position;

a locking bed that is parallel to the length of the handle, the locking bed having an open receiving end that is perpendicular to the length of the handle; and a rotary controller that comprises a rod-shaped, rotary-pivoted element that lies in the locking bed, and a manipulator that lies at a right angle to the rod-shaped, rotary-pivoted element, wherein the manipulator extends beyond the handle for selectively locking and unlocking the blade in the retracted position.

2. The knife according to claim 1, wherein in the knife further comprises a safety lock comprising a locking pressure element configured to lock the blade in an extended position.

3. The knife according to claim 2, wherein the handle cavity extends through the whole length of the handle, thereby defining a first opening and a second opening, wherein the handle cavity further defines a stopping groove which is open at the first opening and blind at the second opening; and wherein the blade further comprises a stop element which corresponds with the stopping groove, thereby preventing the blade from sliding out the second opening.

4. The knife according to claim 2, wherein the pulling element comprises a flexible rollable material.

5. The knife according to claim 1, wherein the handle cavity extends through an entire length of the handle, thereby defining a first opening and a second opening, wherein the handle cavity further defines a stopping groove which is open at the first opening and blind at the second opening; and wherein the blade further comprises a stop element which corresponds with the stopping groove, thereby preventing the blade from sliding out the second opening.

6. The knife according to claim 5, wherein the pulling element comprises a flexible rollable material.

7. The knife according to claim 5, wherein the blade is at least as long as the handle such that when the blade is in the retracted position, the blunt end of the blade extends into the second opening of the handle cavity.

8. The knife according to claim 1, wherein the knife further comprises a locking pressure member; and wherein the rotary controller further comprises a locking member that can interact with the locking pressure member to selectively lock the blade in the retracted position.

9. The knife according to claim 8, wherein the pulling element comprises a flexible rollable material.

10. The knife according to claim 1, wherein the rotary controller further comprises a locking pin; and wherein the blade defines a lock notch, wherein the locking pin can interact with the lock notch to selectively lock the blade in the retracted position.

11. The knife according to claim 10, wherein the pulling element comprises a flexible rollable material.

12. The knife according to claim 1, wherein the pulling element comprises a flexible rollable material.

* * * * *